US005755647A

United States Patent [19]

Watnik

[11] Patent Number: 5,755,647

[45] Date of Patent: May 26, 1998

[54] EXERCISE APPLIANCE FOR ABDOMINAL MUSCLES AND METHOD OF USING SAME

[75] Inventor: Harry R. Watnik, Douglaston, N.Y.

[73] Assignee: Lawrence I. Wechsler, Great Neck, N.Y.; a part interest

[21] Appl. No.: 442,182

[22] Filed: May 16, 1995

[51] Int. Cl.[6] ..... A63B 21/02; A63B 23/02

[52] U.S. Cl. ..... 482/121; 482/140; 482/142; 482/148

[58] Field of Search ..... 482/8, 91, 121–124, 482/129, 130, 140, 142, 128, 148; 601/23, 24; 602/13, 19; 5/464, 633, 639, 640, 643, 652, 935; 297/452.32, 452.37

[56] References Cited

U.S. PATENT DOCUMENTS

| | | | |
|---|---|---|---|
| 414,748 | 11/1889 | Bentley . | |
| 2,264,046 | 11/1941 | McClellan . | |
| 2,558,105 | 6/1951 | Schinman . | |
| 3,276,046 | 10/1966 | Capelli . | |
| 4,210,322 | 7/1980 | Pritchard | 482/142 |
| 4,230,099 | 10/1980 | Richardson . | |
| 4,651,987 | 3/1987 | Day | 482/123 |
| 4,775,148 | 10/1988 | McLaughlin | 482/124 |
| 4,796,315 | 1/1989 | Crew . | |
| 4,823,774 | 4/1989 | Grasser . | |
| 4,903,412 | 2/1990 | Pedrow . | |
| 4,916,765 | 4/1990 | Castronovo, Jr. . | |
| 5,007,633 | 4/1991 | Lemire | 482/142 |
| 5,050,875 | 9/1991 | Lewkovich | 482/128 |
| 5,099,831 | 3/1992 | Freed | 482/130 |
| 5,180,386 | 1/1993 | Kennedy, Jr. . | |
| 5,283,735 | 2/1994 | Gross et al. . | |
| 5,304,109 | 4/1994 | Shockley | 482/142 |
| 5,352,173 | 10/1994 | McLaughlin | 482/121 |

FOREIGN PATENT DOCUMENTS

| | | | |
|---|---|---|---|
| 2058233 | 12/1992 | Canada . | |
| 533206 | 3/1993 | European Pat. Off. | 482/8 |
| 680572 | 9/1992 | Switzerland . | |

*Primary Examiner*—Richard J. Apley
*Assistant Examiner*—Victor K. Hwang
*Attorney, Agent, or Firm*—Wechsler & Wechsler, P.C.; Lawrence I. Wechsler

[57] ABSTRACT

An exercise appliance for conditioning the abdominal muscles of an individual includes a structure presenting a resiliently yieldable contact surface which provides a restoring force against a force applied thereto. The contact surface has a contour suitably sized and shaped to be at least partially fittable in the space formed between a support surface and a static lordotic curve of a lumbar back of an individual positioned with a remaining portion of the back of the individual in contact with the support surface. The structure may provide the resilient yieldability in a form permitting deformation of the contact surface, or may alternately include a rigid member arranged to permit resistive movement thereof in a direction towards a plane of the support surface. By positioning the resiliently yieldable portion of the appliance in the space formed between a support surface and the lumbar back, subsequent attempts by the individual to straighten the lumbar curvature by contraction of the abdominal muscles, forces the lumbar spine to flatten against the counter-force provided by the appliance, conditioning the abdominal muscles responsible for the action. In a further embodiment, the exercise appliance allows selection of the degree of resistance provided by the contact surface, allowing efficient use by individuals of varying levels of physical conditioning. The appliance may also be provided with a sensor which can output an audible or other type feedback signal indicative of the degree of compression of the mass, to insure proper performance of the exercise by the individual.

8 Claims, 7 Drawing Sheets

EXERCISE APPLIANCE FOR ABDOMINAL MUSCLES AND METHOD OF USING SAME

BACKGROUND OF THE INVENTION

The present invention relates to an exercise appliance and a method of using the same for strengthening the abdominal muscles of a user.

Proper conditioning of the abdominal muscles, and primarily the rectus abdominous, is important not only for purposes of cosmetic appearance, but for maintaining integrity of the lower back by inhibiting hyperextension of the lumbar vertebrae. Weakness of the rectus abdominous results in an inability to flex the spine, making it particularly difficult to raise the head and upper truck trunk from a supine position. Uncorrected, this weakness can result in an increased lordotic curve and may become a source of chronic pain.

An understanding of the anatomical structure of the human spine, as well as the actions of associated muscle groups, is important to the development of an exercise appliance effective in isolating involvement to the rectus abdominous, and which limits the deleterious effects on the vertebrae caused heretofore.

The human spine, when viewed from the side, has three basic physiologic curves along its mobile length, each curve associated with a particular region thereof. Occupying the uppermost position along the spine is the cervical region, having a lordotic curvature, i.e. one having anterior convexity. Below the cervical spine is the thoracic region having a curve which is convex posteriorly, referred to as the thoracic or dorsal kyphosis. The next, and lowest curve, is the lumbar region. The lumbar curve is lordotic and of greater curvature than the thoracic curve. Each of the curved regions meets along a midline center of gravity to balance against gravity and provide a stable, upright posture.

The mobility of the three regions of the spine are determined by posterior vertebral articulations, the structure of which differs for each region. Specifically, the articulating surfaces in the thoracic region permit rotation but sharply limit flexion and extension. In contrast, the structure of the vertebral articulating surfaces in the lumbar region inhibits rotation, but allows excellent freedom of extension and adequate flexion. Extension of the lumbar spine well beyond the normal, or static, lumbar lordosis is therefore possible. However, flexion of the lumbar region will at most result in a flattening of the normal lordotic curve, since the geometry of the lumbar vertebrae does not safely permit sufficient flexion to produce kyphosis.

The entire spine is balanced at its base on the sacrum, and pivotally connected to one another through the lumbosacral joint. The sacrum and ilia move as one unit and comprise the pelvis, which in turn is connected to the legs via the hip joints.

Movement of each region of the spine is controlled by a particular muscle or muscle group. The rectus abdominous is responsible for flexion of the lumbar vertebrae, and when toned properly, assists in supporting the lower back against hyper-extension. It is attached at the top to the costal cartilage of the 5th, 6th and 7th ribs and the xiphoid process of the sternum, and below to the pubic bone of the pelvis. Contraction of the rectus abdominous increases the thoracic curve and flattens the lumbar curve by approximating the thorax and pelvis anteriorly. However, since flexion/extension of the thoracic spine is sharply limited, most of the shortening between the thorax and pelvis effected by contraction of the rectus abdominous is attributed to flexion of the lumbar spine. It is believed that this trunk flexion occurs primarily at the lumbosacral joint, accounting for as much as 75% of the total flexion. Additional flexion occurs between the remaining lumbar vertebrae and is limited to a reversal of the static lordosis to a flattened position. Any attempt to go beyond this point, at which the normal lordotic curve is flattened, will place undue stress on the lumbar spine.

Well known in the prior art, the sit-up type exercise has long been relied upon to condition and strengthen the muscles in the abdominal area, and in particular the rectus abdominous. In such exercises, by forcing the rectus abdominous to contract to shorten the distance between thorax and pelvis, the weight of the upper body acting against gravity provides a resistance against the contraction, in turn conditioning the muscle.

Originally, the standard full sit-up was performed by raising the trunk to a sitting position from a supine position, with legs either fully extended or bent at the knees. This motion, however, by applying forces tending to urge the lumbar vertebrae into flexion beyond a flattening of the lordotic curve, was found to exert undue stress on the region of the lower back, often resulting in trauma. Full sit-ups practiced over a prolonged period may lead to degenerative changes resulting in low back mechanical instability, chronic pain or even disability.

To overcome this negative limitation, this type of abdominal conditioning exercise evolved into the well known "crunch" style sit-up, in which an individual in a supine position, with legs bent, raises the head and shoulders a sufficient distance to curl the trank and tense the abdominal muscles. Although alleviating the traumatic effects to the lower back caused by the traditional full sit-up by eliminating the offending range of motion, the "crunch" style sit-up has been less than perfect in providing efficient conditioning of the rectus abdominous.

Another drawback in prior art abdominal strengthening exercises involving trunk raising is the failure to isolate against involvement of other muscles, and in particular the iliopsoas. The iliopsoas is a powerful muscle component of the hip flexors, the group of muscles responsible for rotation of the pelvis about the hip joints, which attaches within the abdomen on the lumbar vertebrae across the pelvis onto the proximal femurs. Bending motion at the waist is accomplished by a combination of actions of the rectus abdominous and hip flexors. When bending at the waist with legs extended, for example in an attempt to touch one's toes in the performance of a full sit-up, trunk flexion effected by contraction of the rectus abdominous alone would not be sufficient to complete the action, since most of the bending of the spine anteriorly is confined to a straightening of the lordotic curve in the lumbar spine. Rotation of the pelvis about the hip joints is therefore necessary to accomplish further bending, which requires contraction of the iliopsoas.

The iliopsoas connects at its upper termination to the anterior lumbar spine. While an individual is standing, or in a supine position with legs fully extended, the pull of the iliopsoas applies mild anterior tension on the lumbar spine, and maintains the static lordotic curve of the lumbar spine.

In a desire to eliminate involvement of the iliopsoas during trunk raising, it has long been suggested that the situp type exercise be performed with legs bent at the knees. By bending the knees, the hips are also flexed, and the iliopsoas is passively shortened. It was thought that placing the muscle in this slackened state would remove its involvement while performing trunk raising. However, subsequent studies have suggested that passively shortening the iliopsoas by flexing the hips in the bent knee position does not eliminate their involvement during performance of the sit-up type exercise. On the contrary, researchers believe the iliopsoas, in a mechanically less effective position when shortened, is loaded to a greater degree than if the trunk raising were to be performed with legs extended and the iliopsoas in a more elongated state. Exercising the iliopsoas through a short arc of motion, as while in the bent knee position with hips flexed, may over time result in over-strengthening and an undesirable shortening of the hip flexors.

Bending the knees and hips while performing a sit-up type exercise also introduces another undesirable effect. When feet are in contact with the floor, bending of the knees flexes the femurs. As a consequence, the pelvis tilts posteriorly, and the lordotic curvature is flattened. The effectiveness of any abdominal exercise performed while in this position, including full and "crunch" sit ups, would be severely limited, since most of range of motion affected by contraction of the rectus abdominous is confined to a straightening of the static lordotic curve of the lumbar spine, of which as much as 75% is due to tilting of the pelvis with respect to the interspace between the fifth lumbar vertebra and the sacrum, which has already been accomplished without using the rectus abdominous. In the bent knee position, the lower abdominal muscles are passively shortened, placing them in a weakened state, and preventing maximum contraction. Moreover, exercising them over the short arc of motion remaining may lead to lower abdominal bulging or an undesirable shortening thereof.

Another exercise, the leg lift, has also been practiced in the prior art in a desire to bring about a strengthening of the rectus abdominous, particularly over the lower region thereof. The classical form of this exercise was performed from a supine position, and consisted of raising both legs, with knees maintaining a straight leg position.

Generally this exercise has been contraindicated, except for extremely well-conditioned individuals, and for the following reasons. During leg raising with both legs fully extended, approximately the first 30 degrees of motion is accomplished by the iliopsoas. Because of the weight of the legs and the poor mechanical advantage, contraction of the iliopsoas in an attempt to elevate the legs instead generally causes an undesirable hyperextension of the lordotic curve, rather than resulting in upward movement of the legs. In addition, the individual may frequently hold his breath during performance of the exercise, which may cause other undesirable effects.

Numerous abdominal exercise appliances have been provided in the prior art, in an attempt to condition and strengthen the rectus abdominous. However, in many ways these have failed to adequately address the need for a portable, lightweight appliance which when used, effectively isolates and safely exercises the rectus abdominous and other abdominal muscles.

OBJECTS AND SUMMARY OF THE INVENTION

Accordingly, it is an object of the invention to provide an exercise appliance and a method of using the same for strengthening the abdominal muscles of a user, particularly the rectus abdominous, which overcomes the drawbacks of the prior art.

It is a further object of the invention to provide the exercise appliance and a method of using the same which isolates the abdominal muscles and minimizes involvement of the hip flexors.

It is a still further object of the invention to provide the exercise appliance and a method of using the same which exercises the rectus abdominous over a wider range of motion, firing the muscle at a higher intensity, for enhanced strengthening and conditioning, while reducing lumbosacral mechanical stress.

It is a still further object of the invention to provide the exercise appliance and a method of using the same which is effective for training an individual to maintain correct posture by teaching the motion of the posterior pelvic tilt.

It is a yet further object of the invention to provide the exercise appliance which is suitable for use by individuals of various degrees of physical conditioning, and in a form which is economical, lightweight, compact and portable.

Briefly stated, there is provided an exercise appliance for strengthening and toning the abdominal muscles of an individual. The appliance includes a resiliently yieldable structure presenting a contact surface, the structure providing a restoring force against a force applied to the contact surface thereon. The contact surface has a contour suitably sized and shaped to be at least partially fittable in the space formed between a support surface and a static lordotic curve of a lumbar back of an individual positioned with a remaining portion of the back of the individual in contact with the support surface. The structure may provide the resiliently yieldable structure in a form permitting deformation of the contact surface, or may alternately include a rigid member arranged to permit resistive movement thereof in a direction towards the support surface. An embodiment particularly adapted for portable use provides the yieldable structure conveniently in the form of a compressible mass fabricated from a resilient material, such as elastomeric foam, thereby providing resistance against deformation of its original shape. One side of the compressible mass will generally be of flattened shape to permit secure contact with the support surface. The other side is of a suitable curved shape to conform with the static lordotic curvature of the individual. Placement of the appliance in the space between the normal lordotic curve and the support surface provides a direct counter-force against an attempt by the individual to straighten the lordotic curve brought about by active contraction of the abdominal muscles, particularly the rectus abdominous. Performing repeated compression of the mass by a straightening of the lordotic curvature effectively conditions and strengthens the abdominal muscles by forcing them to contract against a resistance. In an advantageous embodiment, the exercise appliance allows selection of the degree of resistance against compression, allowing efficient use by individuals of varying levels of physical conditioning. The appliance may also be provided with a sensor which can output an audible or other type feedback signal indicative of the degree of compression of the mass, to insure proper performance of the exercise by the individual.

A method for strengthening the rectus abdominous using the exercise appliance of the present invention includes placing the resiliently yieldable portion of the appliance in the space formed between a support surface and a normal lordotic curve of an individual positioned with a back of the individual in contact with the support surface. The support surface may be a floor, table top or exercise bench, in which case the individual lies in a supine position. Alternatively, the support surface may be a vertical wall, and the individual in an upright posture, stands with his back in contact with the wall. Still further, the individual may be in sitting position on a chair or other structure providing back support, placement of the appliance serving to restore static lordotic curvature to the lumbar region otherwise straightened by the relaxation of the pull of the iliopsoas on the anterior lumbar spine brought about by flexion of the hips while in the sitting position. Following placement of the appliance, the individual attempts to straighten the lumbar curvature by a contraction of the rectus abdominous and other abdominal muscles, including the internal and external obliques and transverse abdominous, which action causes the lumbar spine to flatten against the counter-force provided by the appliance. Because of the anatomy of the rectus abdominous, two types of contractions may be performed to accomplish a flattening of the lordotic curve. The rectus abdominous is thought to act as a two joint muscle, i.e. providing contraction over two regions thereof, to effect different motion. The two regions include the lower rectus abdominous below the navel to where it connects to the pubic bone of the pelvis, and the upper rectus abdominous from above the navel to its connection to the lower end of the rib cage. Contracting both the lower and upper regions together results in a contraction referred to as simultaneous or countercurrent. A more effective practice is to perform the contractions of each region in sequence, known as a concurrent contraction, which fires the muscle more powerfully for more efficient conditioning. Therefore, advantageously, conditioning of the rectus abdominous may be divided into two exercises, each performed separate from the other, directed to one of the upper and lower abdominal regions. To concentrate on conditioning the lower abdominal, the individual will posteriorly tilt the pelvis by actively contracting the rectus abdominous primarily over its lower region. If instead the individual wishes to concentrate on the upper abdominal region, the head and shoulder blades are raised by a contraction the rectus abdominous an amount sufficient to cause a flattening of the lordotic curve, and a compression of the compressible mass of the exercise appliance, which provides resistance against the contraction. With both exercises, the degree of conditioning is most effective with hips extended rather than flexed.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
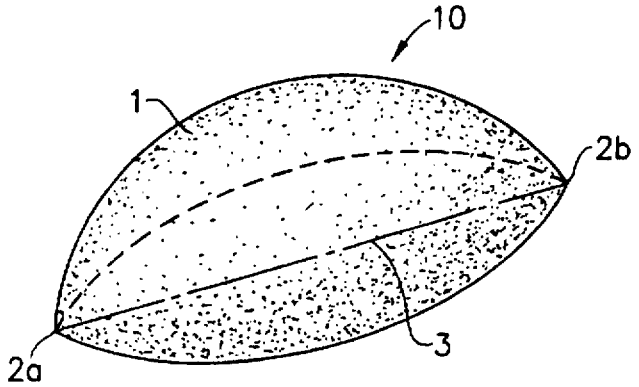
FIG. 1 is perspective view of an embodiment of the exercise appliance in accordance with the present invention.

Referring now to the figures, and in particular FIG. 1, there is shown, generally at 10, an abdominal exercise appliance, in accordance with the invention. Abdominal exercise appliance 10 of the preferred embodiment is made of a compressible foam and formed in a shape suitable for placement between the lumbar spine of an individual and a support surface against which a remaining portion of a back of the individual is in contact. In the embodiment shown in FIG. 1., the shape is that of a longitudinally bisected football, having a curved upper surface 1 and opposed end poles 2*a* and 2*b* at the termination points of a longitudinal axis 3. In this embodiment, abdominal exercise appliance 10 is designed to be positioned during use with longitudinal axis 3 oriented in a direction across the individuals back. The compressible foam from which abdominal exercise appliance 10 is formed is a resilient material which resists compression and which returns essentially to its original shape upon a release of an applied force. For example, urethane foams and the like having elastomeric properties perform satisfactorily in such application.

Figure 2:
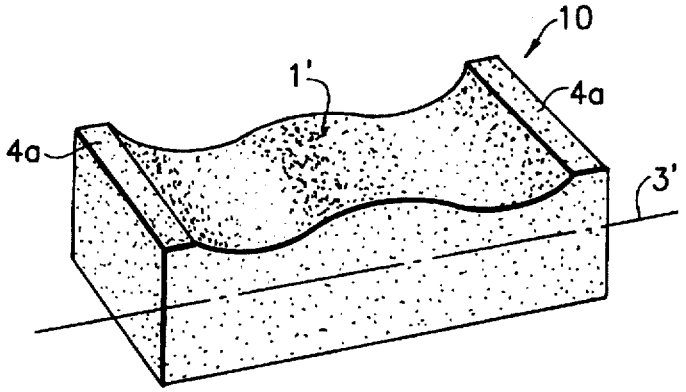
FIG. 2 is perspective view of another embodiment of the exercise appliance in accordance with the present invention.

FIG. 2 is another embodiment of the abdominal exercise appliance, in accordance with the invention, shown generally at 10'. Abdominal exercise appliance 10' is also fabricated or molded from a compressible foam material, and but is instead generally saddle shaped, having a longitudinal axis 3' which is oriented in a direction across the individuals back during use. A curved upper surface 1' is centrally located along longitudinal axis 3'. A pair of lateral supports 4*a* and 4*b* are disposed on lateral ends of abdominal exercise appliance 10' and contact the left and right sides of the individual, to provide stability during performance of the described method of strengthening the rectus abdominous which is discussed in detail below. For purposes of disclosure, it is noted that only two shapes have been shown.

However many others may be developed without departing from the scope of the invention.

Figure 3:
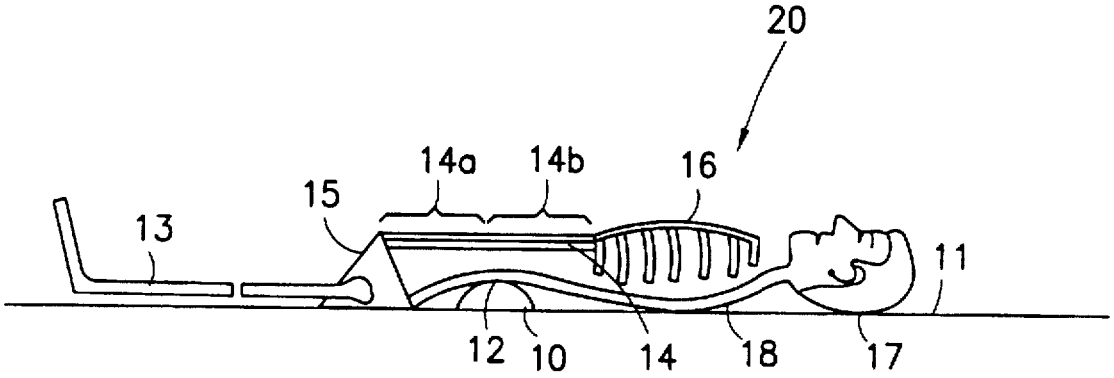
FIG. 3 is a schematic view of an individual prior to performing a method of strengthening the rectus abdominous using the exercise appliance of the present invention.
Figure 4A:
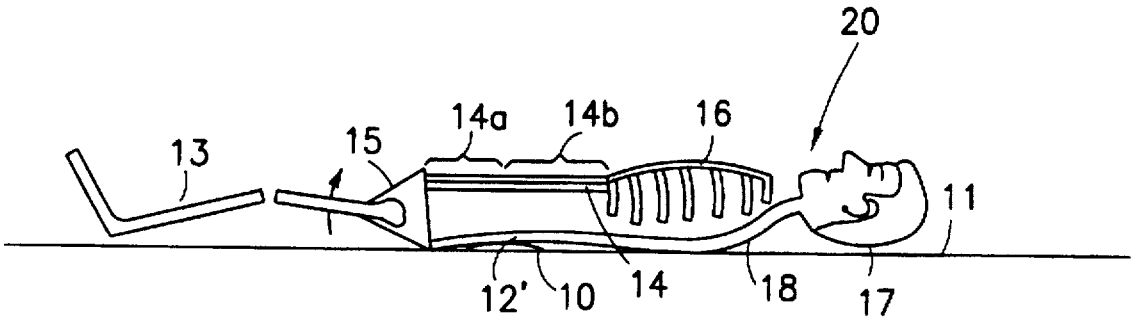
FIG. 4*a* is a schematic view of an individual performing a method of strengthening the rectus abdominous using the exercise appliance of the present invention, with concentration on the lower abdominal region.
Figure 4B:
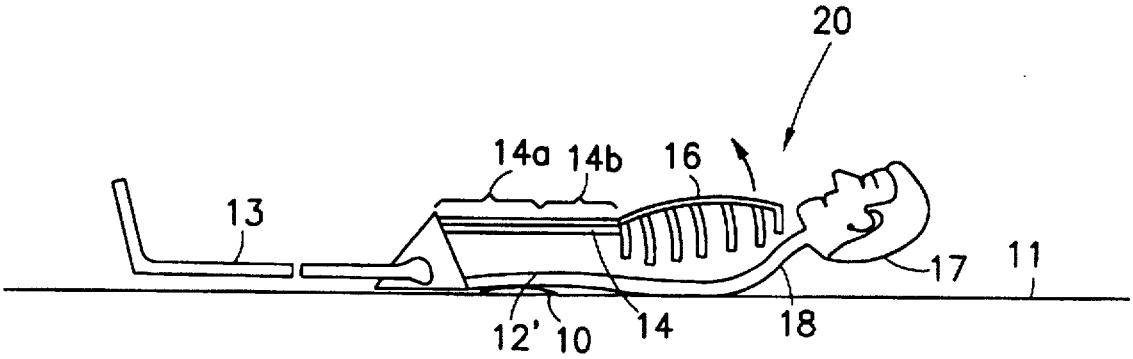
FIG. 4*b* is a schematic view of an individual performing a method of strengthening the rectus abdominous using the exercise appliance of the present invention, with concentration on the upper abdominal region.

Referring now to FIGS. 3, 4*a* and 4*b*, a method of using the abdominal exercise appliance of the present invention will be described. An individual 20 lies, for example as shown, in a supine position on a support surface 11. Support surface 11 may be a floor, a table, exercise bench or any suitable, relatively flat surface. Although a horizontal surface has been selected for purposes of disclosure, the described method may also be performed in an upright position, with the back of individual 20 in contact with a vertical wall. Tilted support surfaces are also feasible. Additionally, the individual may be in an upright sitting position in a chair in supported contact with a back thereof, the back of the chair being the support surface. Moreover, because effective use of abdominal exercise appliance 10 is gravity independent, it may find application in the weightlessness of outer space, requiring, however, that the individual be secured by straps or the like to the support surface during performance of the disclosed method.

Abdominal exercise appliance 10 is fittable between a lumbar spine 12 having a normal or static lordotic curve and support surface 11, as shown in FIG. 3. Where used herein, a normal or static lordotic curvature refers to a degree of curvature generally present in a lumbar spine when an individual with normally healthy posture is in an upright position. It is noted that with legs 13 fully extended, as shown in FIG. 3, the static lordotic curve is maintained by the pull of the iliopsoas on the anterior lumbar spine, creating a space in which abdominal exercise appliance 10 is fittable. However, it is alternatively quite acceptable to bend the knees, relaxing the pull of the iliopsoas, passively straightening lumbar spine 12. In fact, this action is unavoidable, when the exercise is to be performed in a sitting position in a as described below with reference to reference to FIGS. 14, 15*a* and 15*b* chair. Despite the straightening of lumbar spine 12, abdominal exercise appliance 10 is still fittable between lumbar spine 12 and support surface 11, since static lordotic curvature is restorable by effort on the part of the individual to anteriorly tilt the pelvis, designated by the numeral 15 in FIG. 4*a*, i.e. in a direction opposite that indicated by the curved arrow shown. This notwithstanding, the resiliency of abdominal exercise appliance 10 once placed between lumbar spine 12 and support surface 11 is generally sufficient to restore and maintain static lordotic curvature of lumbar spine 12 otherwise straightened by the relaxation of the pull of the iliopsoas on the anterior lumbar spine 12 brought about by flexing the hips, for example while sitting or lying with knees bent. Bending the knees may actually be advisable for certain individuals having an overly developed lordotic curvature, for example where tight hip flexors exert undue anterior pull on lumbar spine 12. These individuals would be advised to bend their knees at least an amount sufficient to release the excessive strain of the iliopsoas, reducing the lordotic curvature to a normal degree.

A rectus abdominous 14 includes a lower abdominal region 14*a* and an upper abdominal region 14*b*. Rectus abdominous 14 connects at its lower termination to the pubic bone of pelvis 15, and at its upper termination to a lower part of a rib cage 16 (the costal cartilage of the 5th, 6th and 7th ribs and the xiphoid process of the sternum). In an advantageous embodiment of the present invention, abdominal exercise appliance 10 has a height, as measured from support surface 11, that slightly exceeds the distance between the apex of the normal lordotic curve of lumbar spine 12 and support surface 11. In this way, a gentle upward pressure is exerted against lumbar spine 12 by abdominal exercise appliance 10 prior to performing any action, however not enough to cause excessive hyperextension. Rectus abdominous 14 is placed in a condition of prestretch as a result of the pre-applied upward force on lumbar spine 12. Studies have shown that moderate prestretching of a muscle immediately preceding a contraction thereof, enables it to contract more forcefully than if prestretching is not performed, increasing the rate of beneficial conditioning of the muscle during exercise, as well as preventing a shortening of the muscle.

It is noted that the rectus abdominous is thought to act much like a two-joint muscle. Capable of controlling two distinct body motions by separate contractions, two-joint muscles are not optimally effective if shortened over both joints simultaneously. Therefore, advantageously, an exercise directed to conditioning such muscles should ideally include contraction of each of the two regions, separate of the other. Similarly, to obtain the most forceful contraction, and hence the most concentrative conditioning in each of the two regions of contraction of the rectus abdominous, i.e. the lower part thereof, where it connects to the pelvis, and the upper part, where it connects to the rib cage, each region should be made to contract separately from the other. It must be noted, however, that the region not actively contracted still fires and is not completely silent.

Referring now to FIGS. 4*a* and 4*b*, two actions are illustrated, one directed to the conditioning of lower abdominal region 14*a*, and the other to the conditioning of upper abdominal region 14*b*, respectively. Referring first to FIG. 4*a*, a compression of abdominal exercise appliance 10 is accomplished by initiating contraction of lower abdominal region 14*a*. Individual 20 concentrates on tilting pelvis 15 posteriorly, i.e. in the direction as indicated by the curved arrow, by active contraction of rectus abdominous 14, and in particular lower abdominal region 14*a*. At the same time, head 17 and shoulder blades 18 are maintained in contact with support surface 11, which if lifted, would cause simultaneous contraction of upper abdominal region 14*b*, thereby weakening the contraction of lower abdominal region 14*a*. The normal lordotic curve of lumbar spine 12 is flattened by the contraction of lower abdominal region 14*a* to effect the tilting of pelvis 15 posteriorly, as illustrated in the figure the flatten position of lumbar spine designated 12' in FIGS. 4*a* and 4*b*. The resisting force against compression of abdominal exercise appliance 10 provides loading on the contracting lower abdominal region 14*a*. Once compression of abdominal exercise appliance 10 is complete, individual 20 allows pelvis 15 to tilt anteriorly, returning it to its original position in FIG. 3, and relaxing lower abdominal region 14*a*. In this position, abdominal exercise appliance 10 returns to its original shape, and in accordance with the aforementioned advantageous embodiment, places rectus abdominous in prestretch, providing maximum conditioning from subsequent compression. The above described actions are performed for a desired number of repetitions to effectively condition lower abdominal region 14*a* of rectus abdominous 14.

Turning now to FIG. 4*b*, a compression of abdominal exercise appliance 10 is accomplished by initiating contraction of upper abdominal region 14*b*. Individual 20 now concentrates on moving head 17 and shoulder blades 18 away from support surface 11, as indicated by the direction of the curved arrow, to curl the trunk, by active contraction of rectus abdominous 14, and in particular upper abdominal region 14*b*. The normal lordotic curve of lumbar spine 12 as shown in FIG. 3, is moved to flatten lumbar position 12' by the contraction of upper abdominal region 14b to effect a curving of the trunk by pulling on the rib cage 16 where rectus abdominous 14 connects thereto, as illustrated. Ideally, care is taken not to allow pelvis 15 to tilt posteriorly by action of lower abdominal region 14a to assist in the flattening of lumbar spine 12'. If such were permitted to occur, the simultaneous contraction of lower abdominal region 14b would hinder as forcible a contraction of upper abdominal region 14b. Head 17 and shoulder blades 18 are lifted only an amount sufficient to flatten the normal lordotic curve of lumbar spine 12' as shown in FIG. 3 to flatten lumber position 12' and to compress abdominal exercise appliance 10. At this point shoulder blades 18 should generally just clear support surface 11. There is no beneficial reason for going beyond this point since lumbar spine 12 does not safely permit sufficient flexion to produce kyphosis. The resisting force against compression of abdominal exercise appliance 10 provides loading on the contracting upper abdominal region 14b. Once compression of abdominal exercise appliance 10 is complete, individual 20 lowers head 17 and shoulder blades 18 back to contact with support surface 11, returning to the original position in FIG. 3, and relaxing upper abdominal region 14a. In this position, abdominal exercise appliance 10 returns substantially to its original shape, as with the previously described method embodiment. The above described actions are performed for a desired number of repetitions to effectively condition upper abdominal region 14a of rectus abdominous 14.

Figure 14:
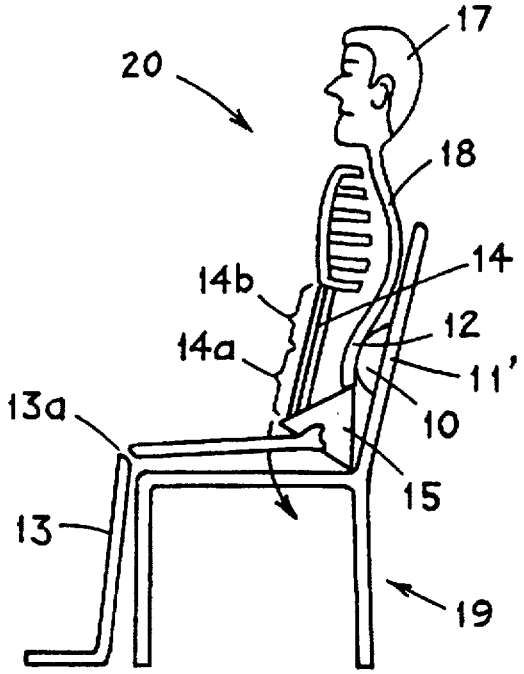
FIG. 14 is a schematic view of an individual prior to performing a method of strengthening the rectus abdominous using the exercise appliance of the present invention in a seated position.
Figure 15A:
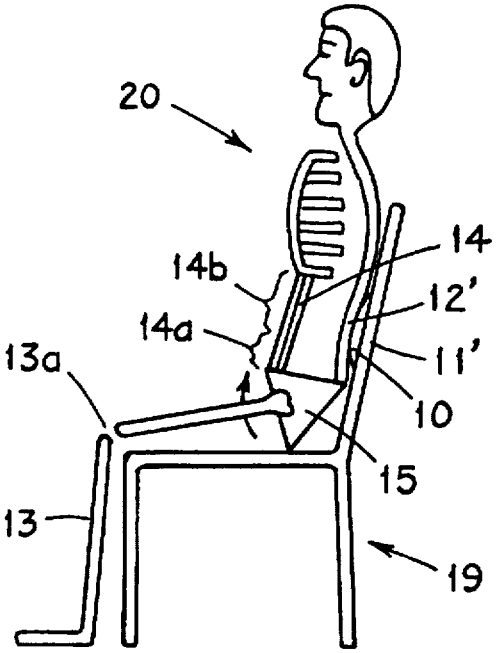
FIG. 15*a* is a schematic view of an individual performing a method of strengthening the rectus abdominous using the exercise appliance of the present invention while seated, with concentration on the lower abdominal region.
Figure 15B:
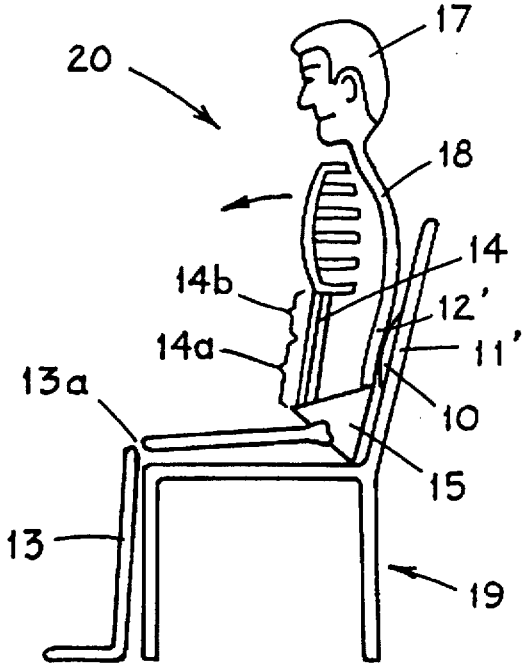
FIG. 15*b* is a schematic view of an individual performing a method of strengthening the rectus abdominous using the exercise appliance of the present invention while seated, with concentration on the upper abdominal region.

Referring now to FIGS. 14, 15a, and 15b, use of the abdominal device when a user is in a seated position is described. An individual 20 sits on a suitable chair 19 advantageously having a secure chair back 11' which serves as a support surface. As mentioned herein, bending of knees 13a of legs 13 of individual 20 when normally seated in upright-backed chair 19 passively straightens lumbar spine 12 by relaxing the pull of the iliopsoas on pelvis 15. Therefore, as noted herein, and as depicted in FIG. 14, prior to performing a repetition in accordance with an embodiment of the invention, before individual 20 restores the lordotic curvature of lumbar spine 12 by anteriorly tilting the pelvis, i.e. in the direction indicated by the curved arrow, creating a space in which exercise appliance 10 is fittable. Generally, once placed, the restoring force provided by exercise appliance 10 is sufficient to assist in restoring the curvature to lumbar spine 12 from a flattened orientation 12' as shown in FIGS. 15a and 15b, for subsequent repetitions. From this position, two exercises targeted respectively to the lower and upper abdominal regions 14a and 14b, are shown in FIGS. 15a and 15b. The exercises are performed in an analogous manner to those described with reference to FIGS. 3, 4a and 4b performed in a supine position. For exercise targeted to the lower abdominal region, as shown in FIG. 15a, individual 20 concentrates on tilting pelvis 15 posteriorly in the direction of the curved arrow. Alternatively, as shown in FIG. 15b, individual 20 concentrates instead on moving head 17 and shoulder blades 18 away from support surface (chair back) 11'. In both cases, once compression of abdominal exercise appliance 10 is complete, individual returns to the starting position depicted in FIG. 14, and the described actions are performed for a desired number of repetitions to effectively condition rectus abdominous 14.

Although the above methods are described with reference to their benefits associated with the rectus abdominous, other abdominal muscles will benefit from performance of the described exercises. Among these, for example, are the internal and external obliques which also play a role in flexing the vertebral column to approximate the thorax and the pelvis when acting bilaterally, will be strengthened when forced to contact against the resisting force of the exercise appliance of the present invention. It is further noted, that although the advantageous embodiments described above are directed to performance of exercises which stress a concurrent contraction of each of the upper and lower regions of the rectus abdominous, benefit to the abdominal muscles will still be derived from performance of a simultaneous contraction, and is contemplated to be within the scope of the invention as claimed herein.

Figure 5:
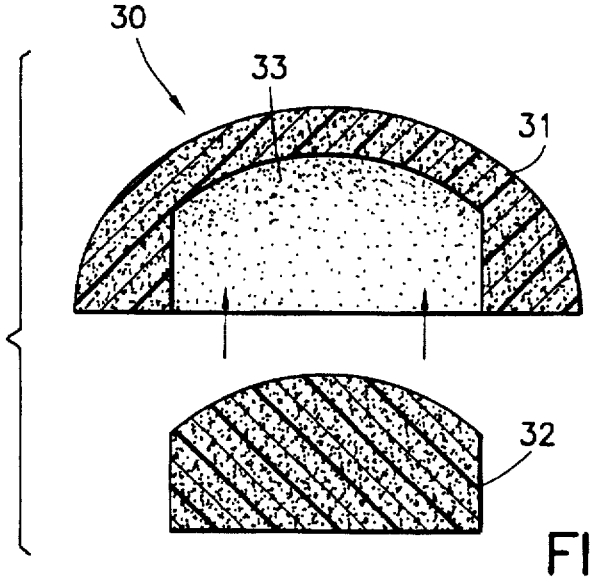
FIG. 5 is cross-sectional view taken of another embodiment of the exercise appliance in accordance with the present invention, including replaceable inserts to vary a degree of resiliency.

FIG. 5 is a cross-sectional illustration of another embodiment of the abdominal exercise appliance, in accordance with the invention, adapted for portable use, which allows selective alteration of degrees of resistance, and is shown generally at 30. Abdominal exercise appliance 30 includes a body 31 and a series of removable inserts 32. Only one of inserts 32 is shown since the dimensions for each are uniform. Body 31 is molded or fabricated from a compressible foam material, and has an external shape and physical characteristics in conformance to those discussed with regard to the embodiments of FIGS. 1 and 2. A cavity 33 is formed for captively receiving a selected one of inserts 32, for example, having an opening thereof in the lower surface of body 31. In an advantageous embodiment, inserts 32 have external dimensions slightly larger than the internal dimensions of cavity 33, requiring inserts 32 to be press fit into cavity 33, thereby holding body 31 in joined relationship to the selected one of inserts 32. Inserts 32 are made of a foam material, each member of the set having a different density from remaining ones of the set, to present a different modulus of elasticity, i.e. degree of compressive resiliency, of abdominal exercise appliance 30 based on which insert 32 is installed in body 31. It is noted that by disposing the opening of cavity 33 such that inserts 32 are inserted from the flat side of body 31, i.e. the side designed to contact the support surface, the effect of the density of the insert selected on the compressibility of the overall abdominal exercise appliance 30 by orientation in direct relation to the compression forces generated by a straightening of the lumbar lordosis is maximized. Physical alignment with the direction of the applied compressive force also provides better mechanical stability of abdominal exercise appliance 30 during use.

It will be understood by those skilled in the art that although only foam inserts have been shown for purposes of disclosure many other suitable possibilities exist for accomplishing the same result. For example, instead of varying foam density, springs having various compression characteristics may be imbedded within a uniform density foam insert, each insert for insertion into the body. Or, by way of further example, air or hydraulic pressure may be varied within a bladder located within the body to accomplish variance of degree of compressibility of the abdominal exercise appliance.

Figure 6:
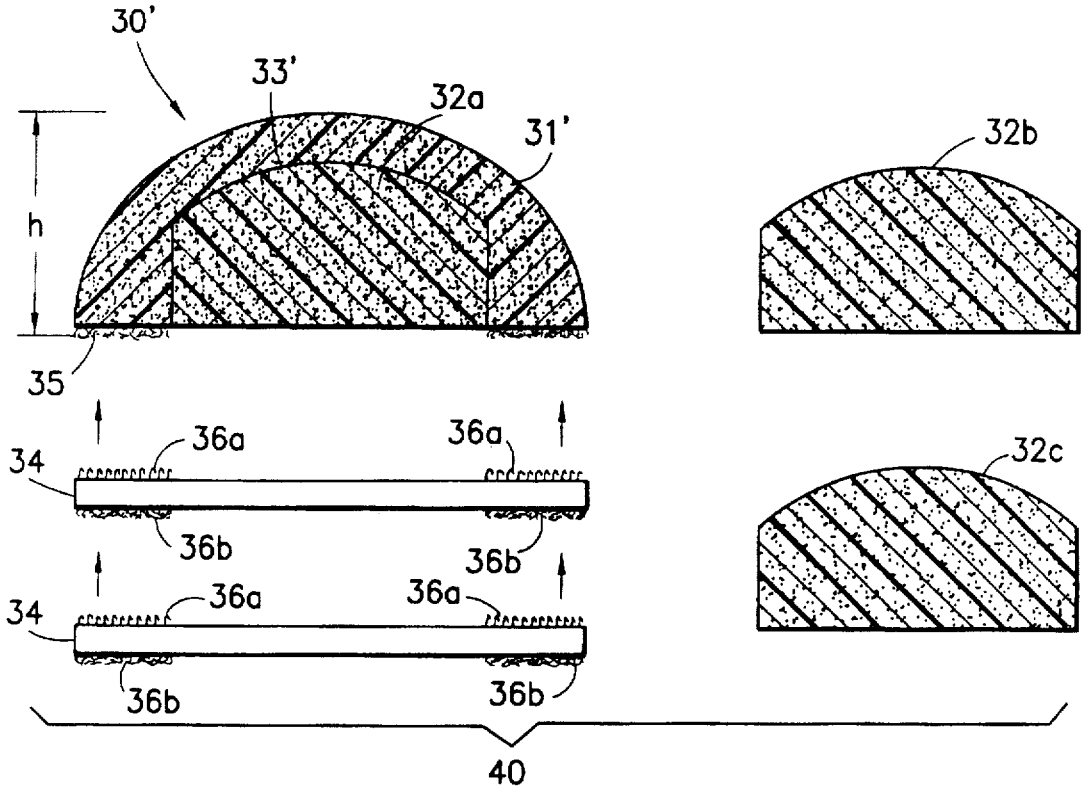
FIG. 6 is a cross-sectional view of an abdominal exercise kit.

The present invention will find application among a large cross-section of the population. Lordotic curve varies with the individual, and consequently so too the space between the lumbar spine and the support surface, within the meaning of the term static lordotic curve as used herein. In addition, each individual will differ as to their level of conditioning and strength. Therefore, the present invention may be conveniently produced and supplied in kit form, providing the individual with practical means for selectively altering the various parameters of the abdominal exercise appliance, including height and resiliency. Referring to FIG. 6, a customizing exercise kit is shown generally at 40. Included in customizing exercise kit 40 is abdominal exercise appliance 30' and inserts 32*a*, 32*b*, and 32*c*. As in the previously described embodiment, exercise appliance 30' is comprised of a body 31' and a cavity 33' formed therein for receiving a selected one of inserts 32*a*, 32*b*, and 32*c*. In the figure, insert 32*a* is shown inserted within cavity 33' in body 31'. The minimum height h of abdominal exercise appliance 30' is selected based upon a statistical minimum lordotic curve of the population, since its height may only be increased over minimum height h. Body 31' and inserts 32*a*, 32*b*, and 32*c* are of the same shape and material as those described prior with regard to the embodiment shown in FIG. 5.

Customizing exercise kit 40 further includes at least one height adjustment spacer 34 (two are shown). Height adjustment spacers 34 are flat, conveniently having a perimeter matching in shape that of body 31', and are made of a compressible foam material having similar characteristics to those from which body 31' and inserts 32*a*, 32*b* and 32*c* are produced. One consideration, however, is that the foam used to make height adjustment spacers 34 should not be so resilient as to resist compression entirely, and prevent complete flattening during use, nor should they be too soft so as to prematurely collapse when used in conjunction with a more resilient one of inserts 32*a*, 32*b* and 32*c*. Disposed on the lower surface of body 31' are means for mechanically interconnecting body 31' with a height adjustment spacer 34 placed adjacent thereto. In an advantageous embodiment, an attachment layer 35 is made of one of the component elements of a gripping fabric such as for example the type manufactured under the trade name VELCRO, and is fixed to the lower surface of body 31' with the gripping surface facing outwardly. Height adjustment spacers 34 also have spacer attachment layers 36*a* and 36*b*, attachment layer 36*a* being made of the component element adapted to cooperate with the element of attachment layer 35, and attachment layer 36*b* made of the same component element as attachment layer 35. As a result, any number of height adjustment spacers 34 may be removably added to body 31' to increase the height of abdominal exercise appliance 30' in excess of minimum height h as required to obtain proper fit to the individual.

Figure 7:
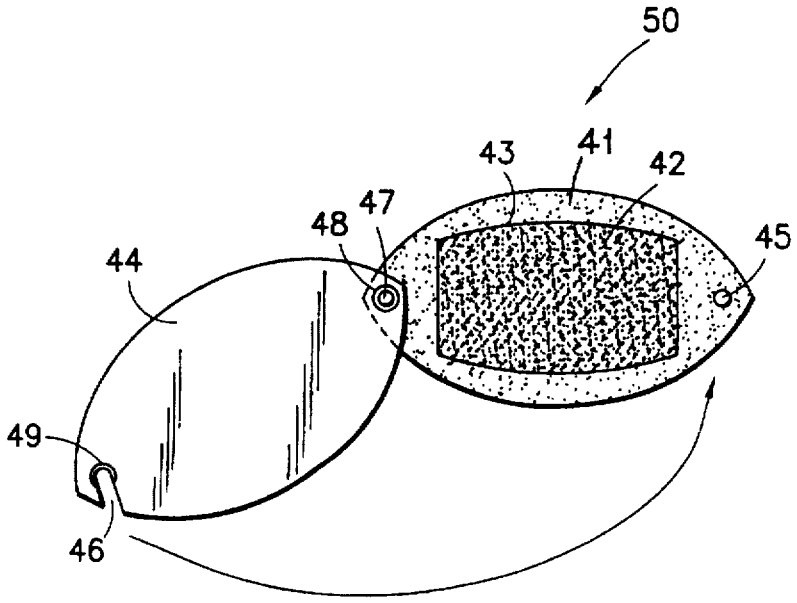
FIG. 7 is a bottom elevation of a further embodiment the exercise appliance in accordance with the present invention, including means for providing structural rigidity.

Referring now to FIG. 7, another embodiment of the abdominal exercise appliance, in accordance with the invention is shown, generally at 50. This further embodiment includes a feature particularly useful when performing the exercise on a padded surface, for example an exercise mat, as is often desirable insofar as there is reduced danger of trauma to various portions of the body in contact with the support surface. A body 41, fabricated from a compressible foam material, and having an external shape and physical characteristics in conformance to those discussed with regard to the embodiments of FIGS. 1 and 2, includes a cavity 43 formed therein, having an opening in a lower surface of body 41, i.e. the flattened surface facing the support surface during use, for captively receiving an insert 42, selected from a set of inserts (not shown) having varying density, as has already been addressed herein. When performed on a mat, the exercise method performed in accordance with the invention may result in an uneven distribution of forces causing an undesirable deformation of the mat itself below the exercise appliance, particularly when the mat is softer than the particular degree of resilient counterforce selected for the exercise appliance. Consequently maximum conditioning is prevented. Addressing this consideration, an embodiment of abdominal exercise appliance 50 includes means providing rigidity in a plane parallel to and proximate with the support surface, provided, for example, in the form of a plate member 44. Plate member 44 is constructed of any suitable material which can provide rigidity to abdominal exercise appliance 50 and thereby allow even distribution of pressure in the direction of the support surface applied by a straightening of the static lumbar lordotic curvature during performance of the exercise. Plate member 44 is fastened to the lower side of body 41 by suitable means. In the embodiment as described, for example, plate member 44 is swivelably attached at one end thereof to a corresponding end of body 41. A rivet 47 affixed to body 41 pivotably holds plate member 44 to body 41, a head of which is retained within a countersunk portion 48 recessed below a surface of plate member 44, preventing the head of rivet 47 from protruding beyond the surface of plate member 44, which would otherwise adversely affect stability of abdominal exercise appliance 50, when placed on a rigid support surface, for example when not being used on a compressible mat. Shown in its opened position in FIG. 7 which allows replacement of insert 42, plate member 44 may be subsequently closed by pivoting thereof in a direction of the curved arrow. A rivet 45, affixed to body 41 at an end thereof opposed to rivet 47, is received within a receiving groove 46. Continued rotation of plate member 44 causes a head of rivet 45 to snap into a countersunk receiving portion 49 recessed below a surface of plate member 44. The head of rivet 45 is separated from the lower surface of body 41 a distance approximately equal to the thickness of plate member 44 within the region of countersunk receiving portion 49. Consequently, plate member 44 is maintained in closed position unless pivoted in a direction opposite the arrow, while simultaneously exerting pressure in the region of the countersunk receiving portion in a direction against body 41. It is noted that plate member 44 may have a shape substantially matching a perimeter of body 41, may be slightly smaller, or may be larger, extending even substantially beyond the perimeter of body 41. It is further noted, that plate member 44, in addition to providing rigidity, further provides means for retaining insert 42 captively within cavity 43 of body 41 independent from those already described in the prior embodiments, obviating the need for press-fit engagement.

With regard to the exercise appliance in accordance with the invention, it is noted herein that any means for providing a direct counterforce to a straightening of the static lordotic lumbar curve, the force being directed from behind the individual, is contemplated within the intended scope of the appended claims. For example, although in the embodiment described above the exercise appliance conveniently provides the counterforce in the form of a compressible foam mass, an exercise appliance in accordance with the invention may alternately take the form of an inflatable pillow of suitable shape to be fittable between a support surface and the static lordotic curve of the individual. Compressibility of the trapped air would provide a restoring force to counter a deformation of the pillow. In a further embodiment, as detailed below with reference to the figures, the exercise appliance need not in fact be a confined mass, including rather a structure presenting a curved elastic surface providing resistance to deformation thereof, as described below.

Figure 8:
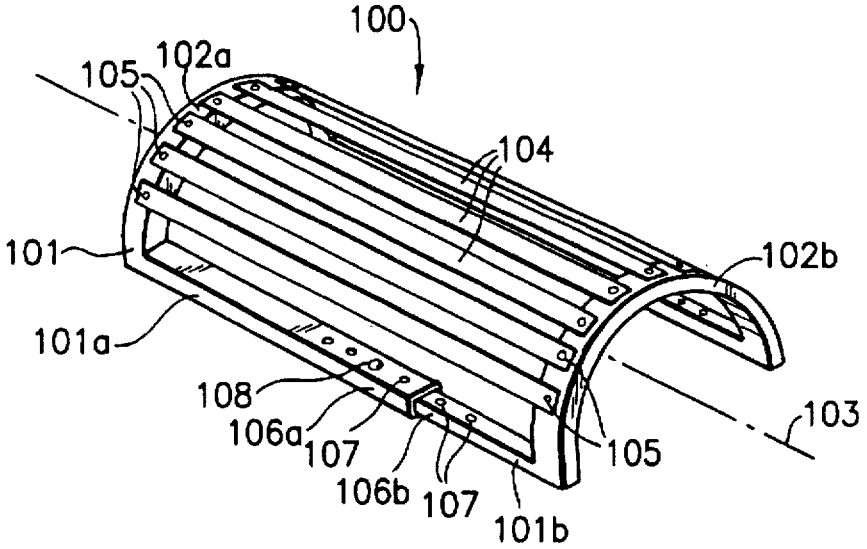
FIG. 8 is a perspective view of another embodiment of the exercise appliance in accordance with the present invention.
Figure 9:
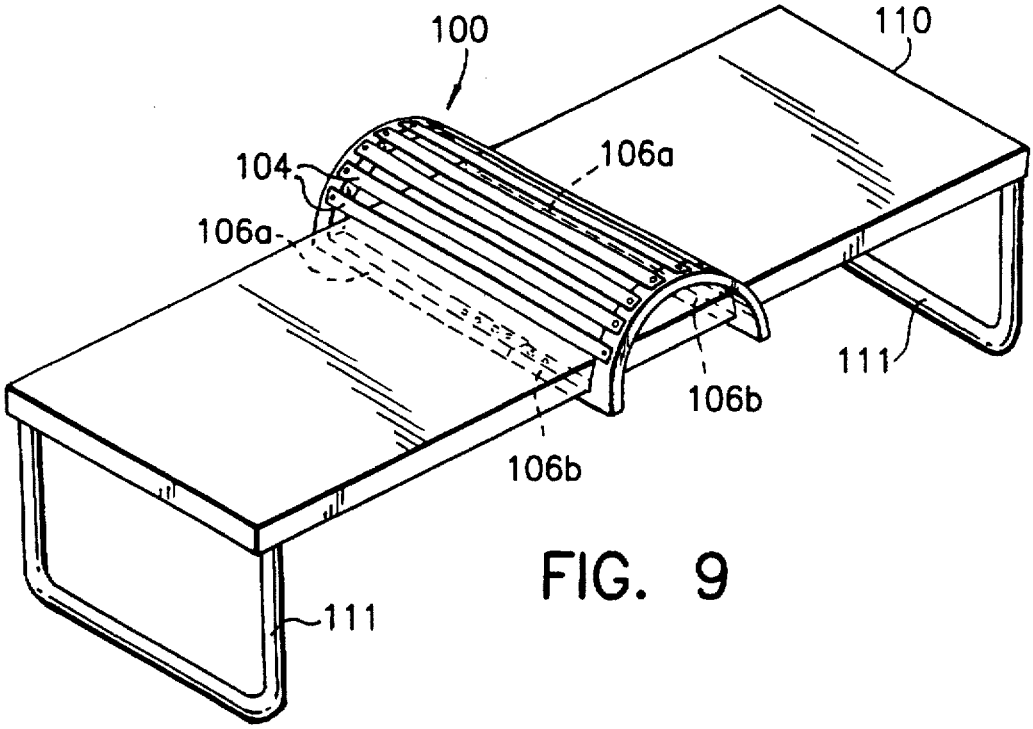
FIG. 9 is a perspective view of an alternate embodiment of the exercise appliance shown in FIG. 8, showing the exercise appliance mounted to an exercise bench.

Referring now to FIGS. 8 and 9, there is shown, generally at 100, an alternate embodiment of an abdominal exercise appliance, in accordance with the invention. Abdominal exercise appliance 100 includes a frame 101 fabricated from a suitable rigid material. Frame 101 is comprised of a pair of interconnected frame sections 101*a* and 101*b*. Frame 101 includes a pair of arcuate portions 102*a* and 102*b* carried on frame sections 101*a* and 101*b* respectively. Arcuate portions 102*a* and 102*b* are disposed laterally, arranged crosswise a longitudinal axis 103 of abdominal exercise appliance 100. A series of elastic band members 104 are attached at their opposed ends to each arcuate portion 102*a* and 102*b*, and are tensioned therebetween, collectively defining a resiliently deformable surface configuration of a shape corresponding to a locus of their connection points 105, shown conveniently as rivets in the figures, on arcuate portions 102*a* and 102*b*. For example, since the locus of points in the present case is semi-circular, the surface defined by elastic band members 104 is that of a longitudinally bisected cylinder. Means for tensioning the series of elastic band members 104 is provided to permit selection of the degree of resistance against deformation of the surface configuration, to provide ideal conditioning to individuals of varying degrees of fitness. In the embodiment as shown for example, frame sections 101*a* and 101*b* are provided with correspondingly sized slide portions 106*a* and 106*b* extending from the ends of arcuate portions 102*a* and 102*b*, to allow reception of one within the other. Slide portions 106*a* and 106*b* function as a base for frame 101, enabling secure contact with a support surface. Slide portion 106*a* is tube shaped, having a generally rectangular cross section, and is sized to receive a smaller, correspondingly shaped slide portion 106*b* for slidable engagement therein. A series of alignment holes 107 are provided through each of slide portions 106*a* and 106*b*, which when aligned, allow frame 101 to be locked in position by inserting a locking pin 108, thereby maintaining a desired tension setting. Arcuate portions 102*a* and 102*b* are sufficiently laterally spaced from one another to permit an individual, during performance of the above described abdominal exercise, to lie between arcuate portions 102*a* and 102*b*, with elastic band members 104 oriented crosswise to the back of the individual, conforming to the static lumbar curvature. Preferably, slide portions 106*a* and 106*b* are of flattened configuration to present a reduced vertical profile, such that they are not raised significantly above the support surface where they would interfere with the back of the individual when the static curvature is straightened. In this regard, however, if the individual is uncomfortable, a pair of mats may be butted against slide portions 106*a* and 106*b* from either side, essentially raising the support surface to be even with, or above, the top surfaces of slide portions 106*a* and 106*b*. This is not an issue when abdominal exercise appliance 100 is used in combination with an exercise bench, a use for which the present embodiment is particularly suited, and which is described below.

Referring to FIG. 9, abdominal exercise appliance 100 is attached to an exercise bench 110 by any suitable conventional clamping means (not shown) or is permanently welded thereto at a point thereon which will not interfere with the slidable tension adjustment means described with regard to the preceding embodiment. Whatever mounting means are employed, it is preferable to allow selective placement of abdominal exercise appliance 100 at a position along the length of exercise bench 110, to compensate for anatomical differences among individuals. Further, the mounting means would, in the preferred case, allow raising and lowering of abdominal exercise appliance 100 with respect to exercise bench 110 to permit the height of the curved elastic surface above the surface of exercise bench 110 to be selectively altered dependent upon the degree of static lordotic curvature of the particular individual. Exercise bench 110 is raised above the floor by a pair of support members 111, the top surface of exercise bench 110 providing the support surface for the individual lying in a supine position. In this application, slide portions 106*a* and 106*b* are oriented below the exercise bench (shown by broken lines in FIG. 9) and therefore cannot in any way interfere with the back of the individual, particularly when elastic band members 104 are compressed.

Figure 10:
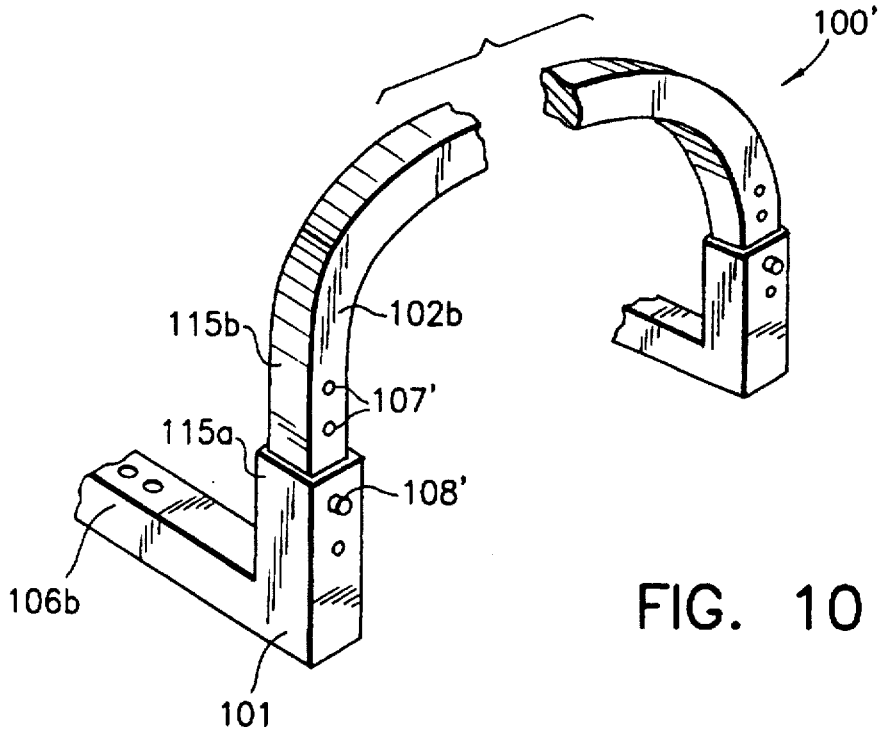
FIG. 10 is the embodiment of FIG. 8 with the addition of a height adjustment mechanism, shown in detail.

It is further noted that means for adjusting the height of the curved elastic surface configuration above the support surface may be provided when the above embodiment is used separate from a bench. FIG. 10 illustrates an abdominal exercise appliance 100', detailing a slide mechanism, similar in structure to slide portions 106*a* and 106*b*, for connecting arcuate portions 102*a* and 102*b* to frame 101. (Note that the detail shows only arcuate portion 102*b*, but the corresponding structure of arcuate portion 102*a* is analogously configured). A tubular frame slide portion 115*a* of rectangular cross section, is sized to receive therein, in sliding engagement, a correspondingly shaped, smaller arcuate slide member 115*b*. A series of alignment holes 107' are provided through each of slide portions 115*a* and 115*b*, which when aligned, allow frame 101 to be locked in position by inserting a locking pin 108', thereby maintaining a desired height setting of abdominal exercise appliance 100'.

It is still further noted, that an abdominal exercise appliance in accordance with the invention may be constructed which includes an elastic layer tensioned between lateral support portions of a frame as detailed above, which instead of including elastic band members, employs an elastic fabric sheet, attached on opposed sides to corresponding lateral support portions, forming a curved elastic surface. Additionally, the support frame need not include arcuate shaped portions. It is only necessary that the locus of connecting points to lateral portions of the support frame create a deformable elastic surface of suitable shape for contact with the lumbar back region, and that the lateral support portions be separated sufficiently so as not to interfere with body motion during exercise. It will also be recognized that many suitable means for varying the tensioning of the stretched elastic layer alternative to those described above may be employed, without departure from the invention.

Figure 11:
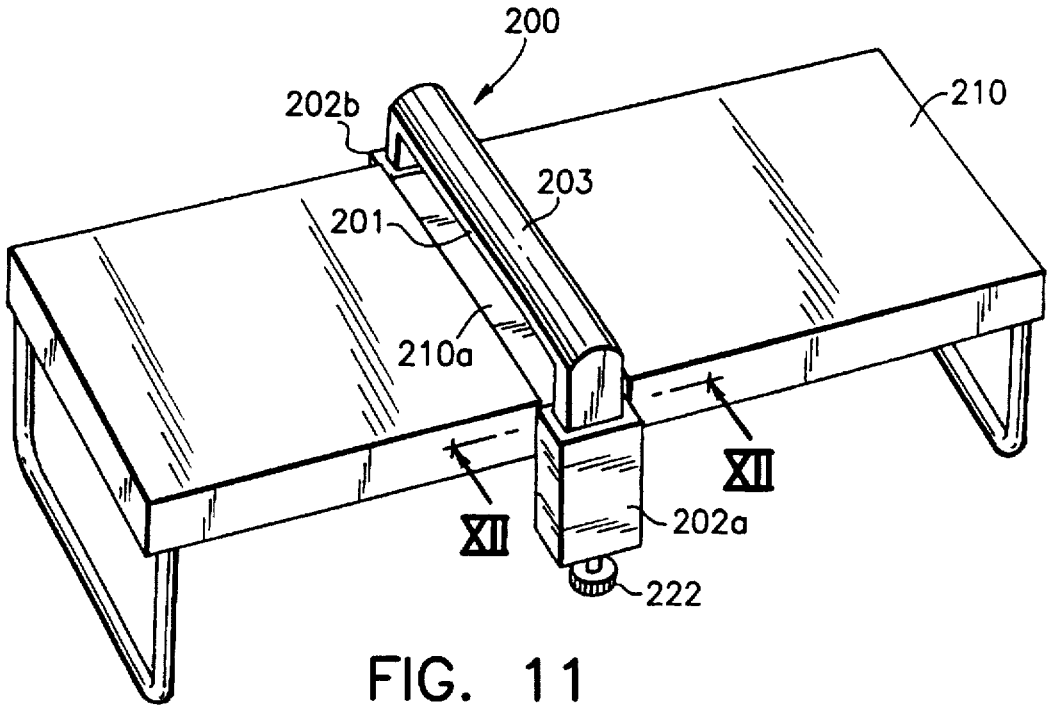
FIG. 11 is a perspective view of a further embodiment of the exercise appliance in accordance with the present invention in combination with an exercise bench.
Figure 12:
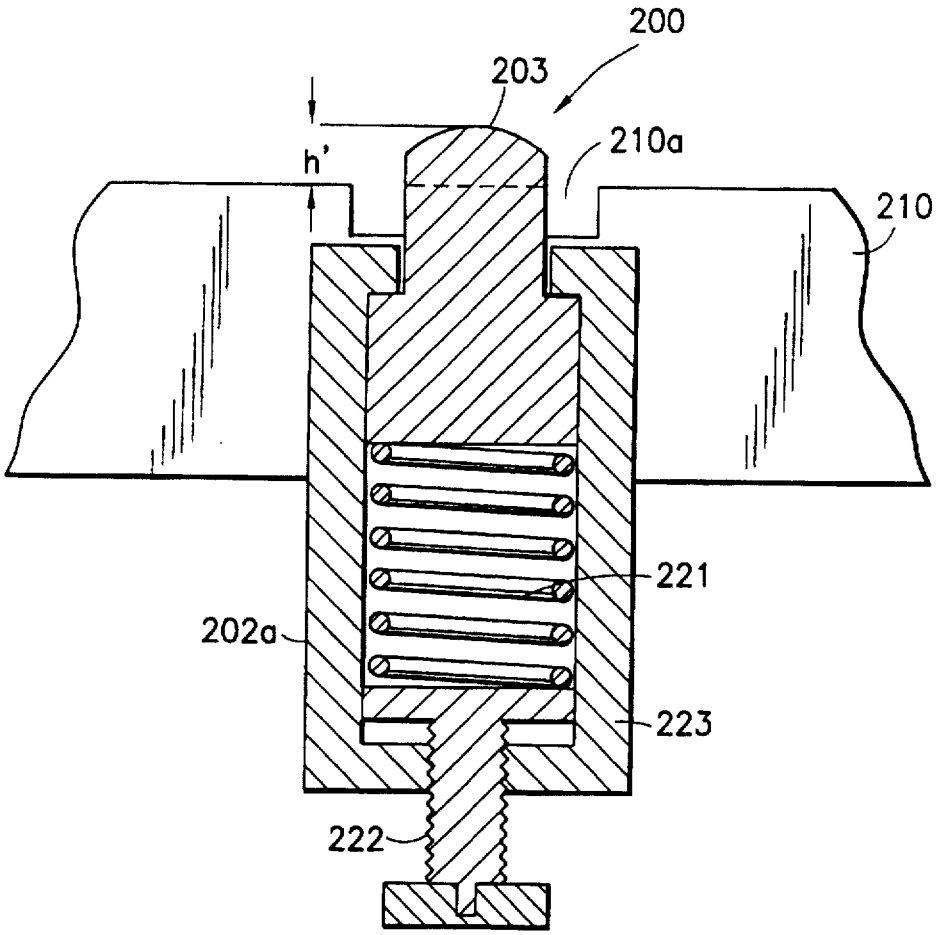
FIG. 12 is a cross-sectional view taken on line XII—XII of FIG. 11.

Turning now to FIGS. 11 and 12, yet another embodiment of the abdominal exercise appliance in accordance with the invention is shown, generally designated 200. Rather than employing a deformable surface against which the lumbar back of an individual applies a deformation pressure during a straightening of a static lumbar lordosis, abdominal exercise appliance 200 includes a rigid bar member 201 arranged crosswise the back of an individual lying on an exercise bench 210, fittable in the space formed between the static lumbar lordosis and a plane of the upper surface of exercise bench 210. Means are provided for permitting resistively yieldable motion of bar member 201 in a direction towards the plane of the upper surface of exercise bench 210. In an embodiment, for example, as illustrated, bar member 201 may be slidably mounted at opposed ends to a pair of lateral side support assemblies 202*a* and 202*b* which are in turn fixedly mounted to exercise bench 210, thereby permitting vertical movement bar member 201. Bar member 201 includes an upwardly facing curved contact surface 203, preferably shaped to conform to a portion of the static lumbar curvature with which it is designed to contact during performance of abdominal exercise. Curved contact surface 203 may optionally be padded for added comfort during exercise. When bar member 201 is in its uppermost position, curved contact surface 203 is at a suitable height h' measured from the plane of the upper surface of exercise bench 210. Height h' is determined in accordance with the preferred dimensional considerations set forth in the previously described embodiments, i.e. slightly exceeding the distance between the apex of the normal lordotic curve of lumbar spine and the plane of the upper surface of exercise bench 210 in the preferred case. Height h' may be changed simply by varying the mounting height of lateral side support assemblies 202*a* and 202*b* on exercise bench 210, or by any number of other conventional alternatives, including, for example, a vertical slide or an adjustable stop disposed within lateral side support assemblies 202*a* and 202*b* which are positioned to restrict maximum vertical travel of bar member 201. Bar member 201 is biased upwardly by biasing means conveniently disposed within lateral side support assemblies 202*a* and 202*b*, provided, for example, in the form of a spring 221, as shown in FIG. 12. Spring 221 provides a resistive counterforce to an approximation of curved contact surface 203 with a plane of the upper support surface of exercise bench 210, and restores bar member 201 to its original height h' above the plane of the upper support surface of exercise bench 210 following release of the applied force. A channel 210*a* runs crosswise exercise bench 210 disposed below bar member 201. Bar member 201 is received therein when urged downwardly, permitting an apex of curved contact surface 203 to be substantially in alignment with or below the plane of the upper support surface of exercise bench 210. This feature allows an individual to completely straighten the lordotic curve of the lumbar spine during performance of the abdominal exercise.

A tensioning screw 222 is threadingly engaged with cooperating threads provided in a lower wall of outer casing 223, and provides means for varying the compression of spring 221 held captive within outer casing 223 of each lateral side support assemblies 202*a* and 202*b*, thereby permitting selective variance of the degree of resistive counterforce.

Figure 13:
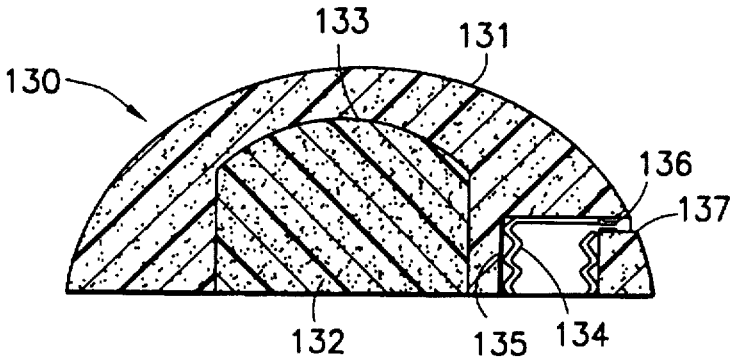
FIG. 13 is a cross-sectional view of a further embodiment of the exercise appliance in accordance with the present invention, including means for emitting an audible feedback signal in response to compression.

In addition to its use in conditioning the abdominal muscles, the present invention will also find utility in teaching the posterior pelvic tilt. The posterior pelvic tilt is a practice useful in improving posture and maintaining integrity of the lower back by reducing the lordotic curvature of the lumbar spine, however the mechanics of its performance are often difficult for a patient to learn. In yet another embodiment in accordance with the invention, directed in part to this teaching application, an abdominal exercise appliance is shown in FIG. 13 which includes means for audible feedback during performance of the above described abdominal exercise, generally designated 130. The structure of abdominal exercise appliance 130 is equivalent to that already described with reference to FIG. 5, and includes a body 131 and a cavity 133 formed therein for receiving a selected one of a set of inserts of varying compressibility, for example including an insert 132, shown inserted within cavity 133. Means for providing feedback responsive to a compression of abdominal exercise appliance 130 are provided, conveniently for example in the form of a bellows 134 received within a receiving hole 135, a compression of bellows 134 expelling air through an outlet passage 137 communicating with an exterior of abdominal exercise appliance within which a reed 136 is disposed. Compression of abdominal exercise appliance 130 thereby produces an audible feedback signal in response thereto, indicating proper performance of the abdominal exercise or posterior pelvic tilting.

It is noted that any number of other possible arrangements are contemplated which can alternately provide the desired feedback. For example, electronic means sensing and emitting means may be provided as part of any of the embodiments within the scope of the invention to effect emission of a feedback signal in response to application of a compression force brought about by a straightening of the static lumbar lordosis. The feedback signal produced thereby may be audible or any other suitable detectable type. Further, the above selected means may additionally include a means for varying the level of feedback relative to the degree of compression, to further indicate effectiveness of the performance of the exercise by the individual. Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An exercise appliance for strengthening and toning the abdominal muscles, comprising:

a structure presenting a yieldable contact surface, adapted to fit between a static lumbar lordosis of a back of an individual and a support surface when a remaining portion of the individual'back is positioned against the support surface, at least a portion of said yieldable contact surface being disposed in an original spaced apart position from the support surface, said yieldable contact surface being a portion of an exterior of a compressible mass comprised of a resiliently deformable material;

means for providing a resistive counterforce to an approximation of said yieldable contact surface with a plane of the support surface in response to an applied force, and for restoring said at least portion of said contact surface to substantially said original spaced apart position upon a removal of said applied force;

said resistive counterforce being provided in an amount less than a force required to straighten the static lumbar lordosis of the back of the individual over a substantial portion of a maximum allowable approximation of said yieldable contact surface with the plane of the support surface;

means for rendering said yieldable contact surface substantially non-rotational with respect to the support surface during said approximation, said means for rendering said contact surface non-rotational including a flattened portion of said exterior disposed opposite said portion defining said yieldable contact surface;

means for selectively varying a degree of said resistive counterforce, said means for selectively varying a degree of said resistive counterforce including a plurality of inserts, each presenting a different modulus of elasticity; and said compressible mass including a shape defining a cavity therein for receiving a selected one of said plurality of inserts.

2. The exercise appliance according to claim 1, wherein:

said cavity includes an opening disposed in a side of said compressible mass facing the support surface.

3. The exercise appliance according to claim 2, wherein:

each of said plurality of insert are received in press-fit engagement within said cavity.

4. The exercise appliance to claim 1, further comprising:

means responsive to an application of said applied force for emitting a feedback signal.

5. An exercise appliance for strengthening and toning the abdominal muscles, comprising:

a structure presenting a yieldable contact surface, adapted to fit between a static lumbar lordosis of a back of an individual and a support surface when a remaining portion of the individual's back is positioned against the support surface, at least a portion of said yieldable contact surface being disposed in an original spaced apart position from the support surface;

means for providing a resistive counterforce to an approximation of said yieldable contact surface with a plane of the support surface in response to an applied force, and for restoring said at least a portion of said contact surface to substantially said original spaced apart position upon a removal of said applied force;

means for selectively varying a degree of said resistive counterforce;

said yieldable contact surface being a portion of an exterior of a compressible mass comprised of a resiliently deformable material;

means for providing rigidity in a plane parallel to and proximate with the support surface including a plate member; and said plate member is disposed on a side of said compressible mass facing the support surface, pivotably mounted at an end thereof to an end of said compressible mass.

6. An exercise appliance for strengthening and toning the abdominal muscles, comprising:

a structure presenting a yieldable contact surface, adapted to fit between a static lumbar lordosis of a back of an individual and a support surface when a remaining portion of the individual's back is positioned against the support surface, at least a portion of said yieldable contact surface being disposed in an original spaced apart position from the support surface;

means for providing a resistive counterforce to an approximation of said yieldable contact surface with a plane of the support surface in response to an applied force, and for restoring said at least a portion of said contact surface to substantially said original spaced apart position upon a removal of said applied force;

said yieldable contact surface is a portion of an exterior of a compressible mass comprised of a resiliently deformable material;

means for selectively varying a degree of said resistive counterforce including a plurality of inserts, each presenting a different modulus of elasticity; said compressible mass including a shape defining a cavity therein for receiving a selected one of said plurality of inserts;

said cavity includes an opening disposed in a side of said compressible mass facing the support surface; and a plate member disposed on said side of said compressible mass facing the support surface, pivotably mounted at an end thereof to an end of said compressible mass.

7. An abdominal exercise kit for use in strengthening abdominal muscles of a user, said kit comprising:

a resiliently compressible body adapted to at least partially fit between a support surface and a static lumbar lordosis of the user, said body including a curved surface for contacting a lumbar back region of the user and a flattened side opposite said curved surface for contacting the support surface;

a plurality of resiliently compressible inserts, each including a different modulus of elasticity; and said body further including a cavity formed therein, said cavity having an opening in said flattened side for receiving a selected one of said plurality of inserts within said cavity, each said selected one of said plurality of inserts substantially filling said cavity when inserted therein, a side thereof being disposed substantially flush with said flattened side of said body.

8. The kit according to claim 7, further comprising:

at least one spacer engagable with said flattened side, for increasing a distance between the support surface and said curved surface.

* * * * *